US007293587B1

(12) United States Patent
Broberg

(10) Patent No.: US 7,293,587 B1
(45) Date of Patent: Nov. 13, 2007

(54) PORTABLE FUEL ASSEMBLY

(76) Inventor: James E. Broberg, 2819 Oak Ridge Rd., Crystal Lake, IL (US) 60012

( * ) Notice: Subject to any disclaimer, the term of this patent is extended or adjusted under 35 U.S.C. 154(b) by 364 days.

(21) Appl. No.: 10/987,976

(22) Filed: Nov. 12, 2004

(51) Int. Cl.
*B65B 1/04* (2006.01)

(52) U.S. Cl. ..... 141/389; 141/98; 141/231; 141/387; 141/388; 222/470

(58) Field of Classification Search ..... 141/67, 141/98, 231, 387–389; 222/401, 402, 470; 220/212.5
See application file for complete search history.

(56) References Cited

U.S. PATENT DOCUMENTS 1,711,134 A * 4/1929 Brand ..... 222/331
4,602,599 A * 7/1986 Glagola ..... 123/179.9
4,972,972 A * 11/1990 Goguen ..... 222/130
5,667,113 A * 9/1997 Clarke et al. ..... 222/608
6,068,163 A * 5/2000 Kihm ..... 222/189.1
6,325,251 B1 * 12/2001 Santos ..... 222/192
7,108,026 B2 * 9/2006 Luca ..... 141/231
7,163,034 B2 * 1/2007 Franks ..... 141/67

* cited by examiner

*Primary Examiner*—Timothy L. Maust
(74) *Attorney, Agent, or Firm*—Mathew R P Perrone

(57) ABSTRACT

A portable fuel assembly has a holder that securely holds a fuel pump, at least one tool and at least one spare part, while at the same time having a base, which may be attached to a fuel container in order to transport fuel for a remote controlled vehicle to a desired position.

15 Claims, 10 Drawing Sheets

Exploded Perspective View

Top Plan View

Bottom Plan View

Side View

PORTABLE FUEL ASSEMBLY

This invention relates to a fuel assembly, and more particularly to a portable fuel assembly which combines the use of a fuel pump and a tool carrier mounted on a fuel container to provide for easy filling and removal of fuel from a radio-controlled miniature vehicle.

BACKGROUND OF THE INVENTION

Radio-controlled, miniature vehicles are well known as amusement and competition devices. Such vehicles have miniature internal combustion engines. The miniature internal combustion engine requires accessories, such as fuel and tools and spare parts for operation. Such tools include, but are not limited to a screw driver, a plug wrench, a glow plug igniter, an electric vehicle starter and an engine stopper. Needed spare parts include, but are not limited to, glow plugs.

Although the fuel container, spare parts and tools are not large in size, carrying all of these items every time an owner desires to operate a radio-controlled, miniature vehicle can be a problem because most of the time the owner will only need fuel, and possibly a glow plug. Attempting to fill or remove such a vehicle with fuel without a fuel pump can also be a problem because fuel can be spilled upon filling and removal.

Because of the smaller size of this type of vehicle, an appropriate fuel assembly that allows a user to carrying fuel, with a fuel pump, along with a small number of securely attached tools, can be very useful.

Such a fuel assembly must pump fuel into and out of a vehicle, and hold the fuel pump, tools and glow plugs securely, and yet have them readily accessible and permit easy transportation of both the fuel and the equipment thereon. Such a fuel assembly must also allow for the easy pumping of fuel from a fuel container to a vehicle or from the vehicle to the fuel container. Such requirements work against each other. It is very desirable to maximize all advantages, while minimizing the disadvantages.

SUMMARY OF THE INVENTION

Among the many objectives of this invention is the provision of a portable fuel assembly for a radio-controlled miniature vehicle adapted to pump fuel into or out of such a vehicle.

A further objective of this invention is the provision of a portable fuel assembly which securely holds desired equipment such as tools and spare parts.

Yet a further objective of this invention is the provision of a fuel assembly for a radio-controlled vehicle, which is easily transportable.

A still further objective of this invention is the provision of a fuel assembly for a radio-controlled vehicle having tools, fuel bottle and spare parts that are readily accessible.

Another objective of this invention is the provision of a fuel assembly for a radio-controlled vehicle, which is durable.

These and other objectives of the invention (which other objectives become clear by consideration of the specification, claims and drawings as a whole) are met by providing a portable fuel assembly having a holder that attaches to a fuel container and securely holds a fuel pump, at least one tool and at least one spare part.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

The base of a portable fuel assembly securely attaches to a fuel container, which in turn provides a secure foundation for the fuel pump assembly and the tool kit assembly. When a fuel assembly is attached to a fuel container, a first hose from the fuel pump communicates with a fitting attached to the base. The fitting has an aperture that allows fluid to flow through it. The fitting also communicates with a second hose that is inside a fuel container and immersed in fuel.

Additionally, a first end of a third hose communicates with the fuel pump and a second end, oppositely disposed from the first end, communicates with the atmosphere. A combination of a fuel pump that communicates with a first hose which communicates with a fitting, which fitting, in turn, communicates with a second hose immersed in the fuel, and the simultaneous communication of the same fuel pump with a third hose with its second end exposed to the atmosphere, allows fuel to be pumped out of a fuel container and into a radio-controlled miniature vehicle. This combination also allows fuel to be pumped out of a radio-controlled miniature vehicle and back into the same fuel container, with the same pump. The fuel pump is reversible.

In addition to a portable fuel pump assembly, a tool kit assembly is added for the purpose of securely holding tools and spare parts. Such tools include, but are not limited to a screw driver, a plug wrench, a glow plug igniter, an electric vehicle starter and an engine stopper. Needed spare parts include, but are not limited to, glow plugs.

Figure 1:
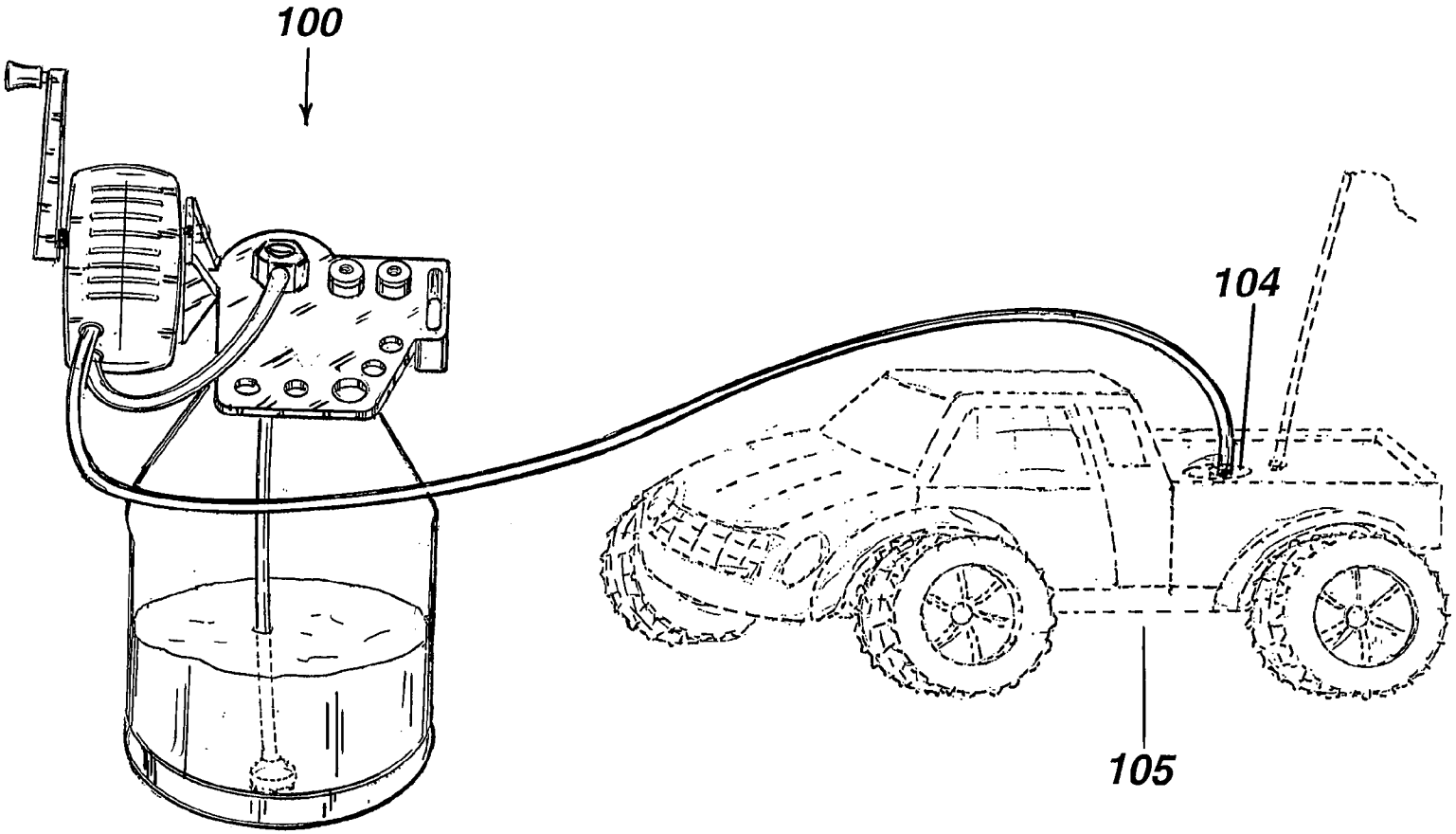
FIG. 1 depicts a perspective view of the first fuel assembly 100 for a radio-controlled vehicle 110 of this invention especially adapted for use with a radio-controlled vehicle 105.
Figure 2:
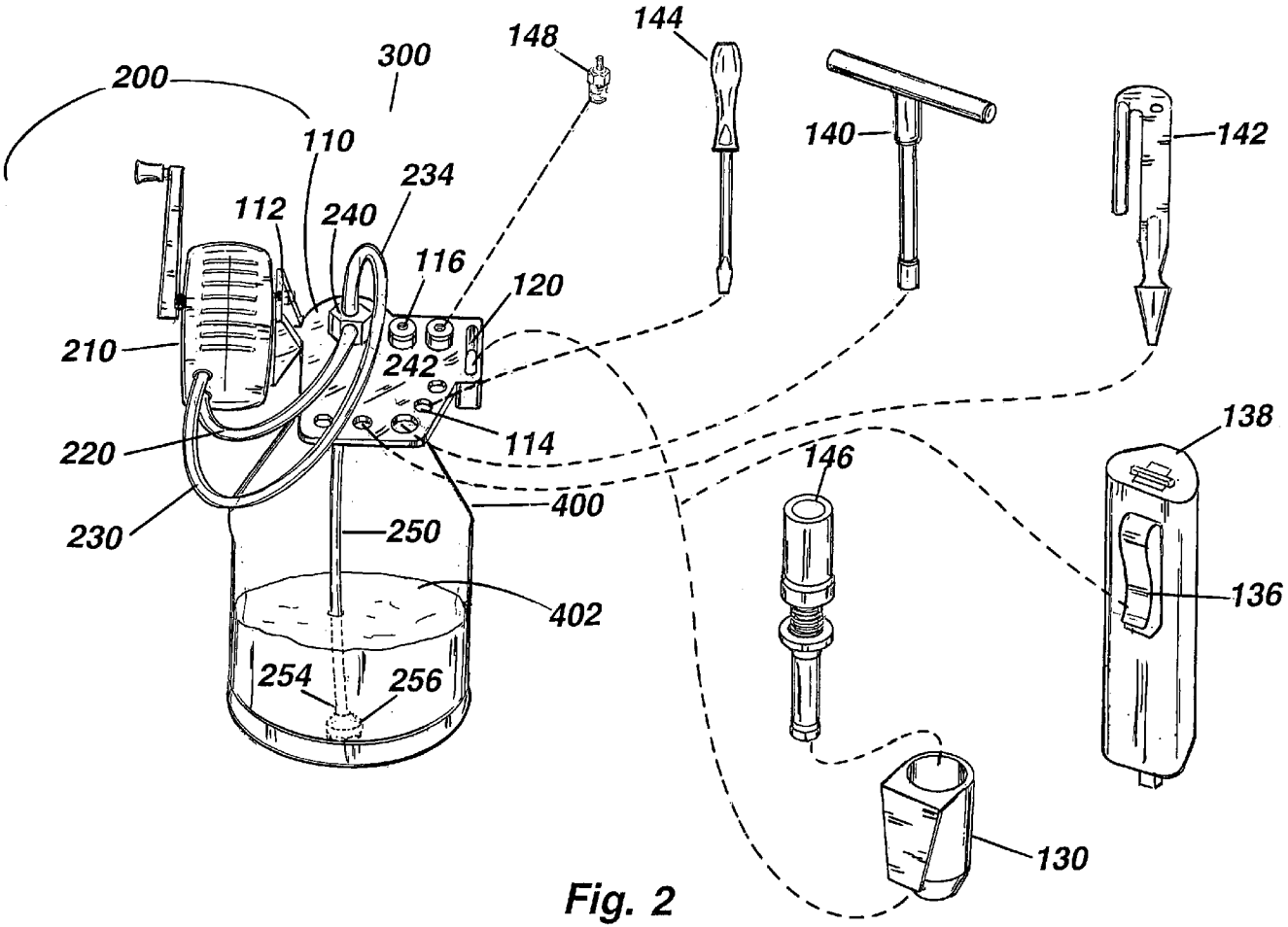
FIG. 2 depicts an exploded, perspective partial cutaway view of the first fuel assembly 100 of this invention, based on FIG. 1.

Referring now to FIG. 1 and FIG. 2, the construction of the portable fuel assembly is evident. First portable fuel assembly 100 includes two major parts: a fuel container base 110 and a mounting bracket 112. The fuel container base 110 supports a tool kit assembly 300 and the mounting bracket 112 supports a fuel pump assembly 200. Base 110 allows for securing of fuel pump assembly 200 and tool kit assembly 300 to circular fuel container 400 and is made of a durable material of any suitable shape. Preferred material for the base is plastic, but other suitable materials, such as wood, metal or ceramic may be used.

Figure 3:
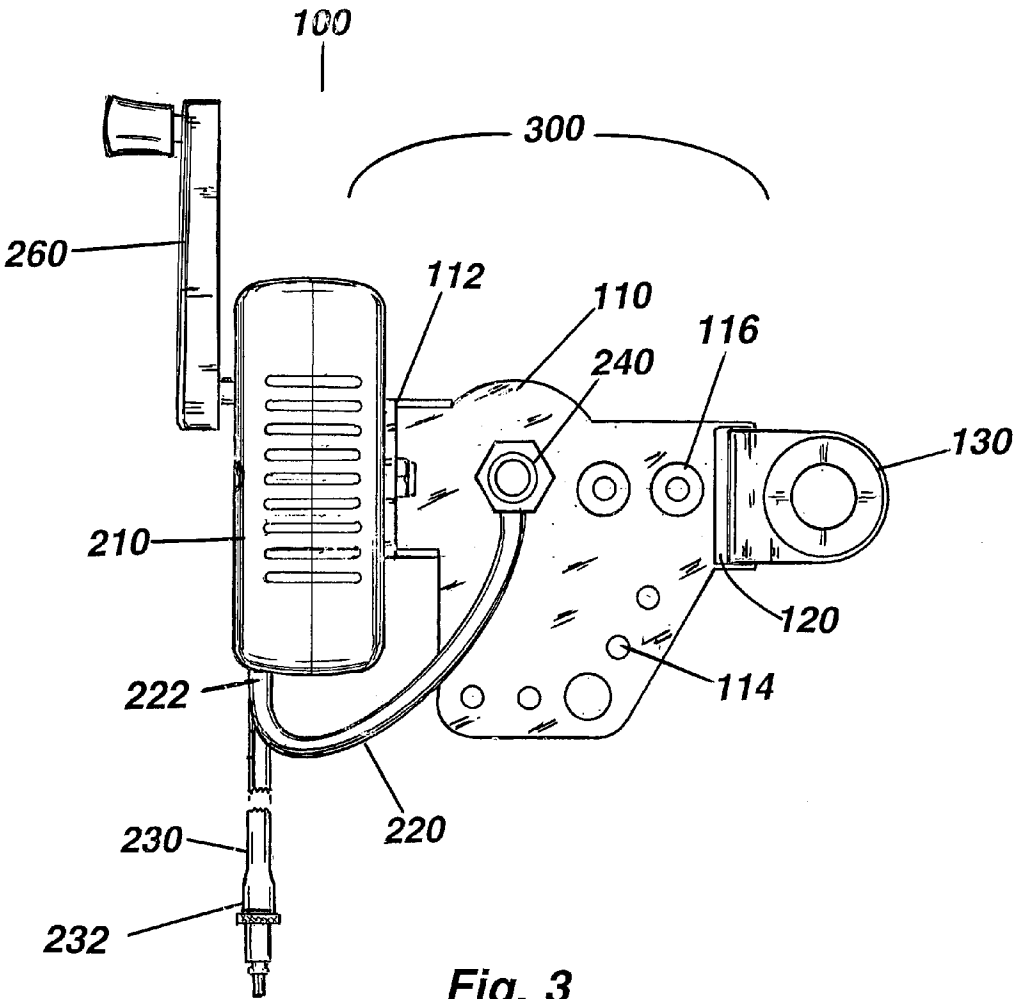
FIG. 3 depicts a top plan view of the first fuel assembly 100 of this invention.
Figure 4:
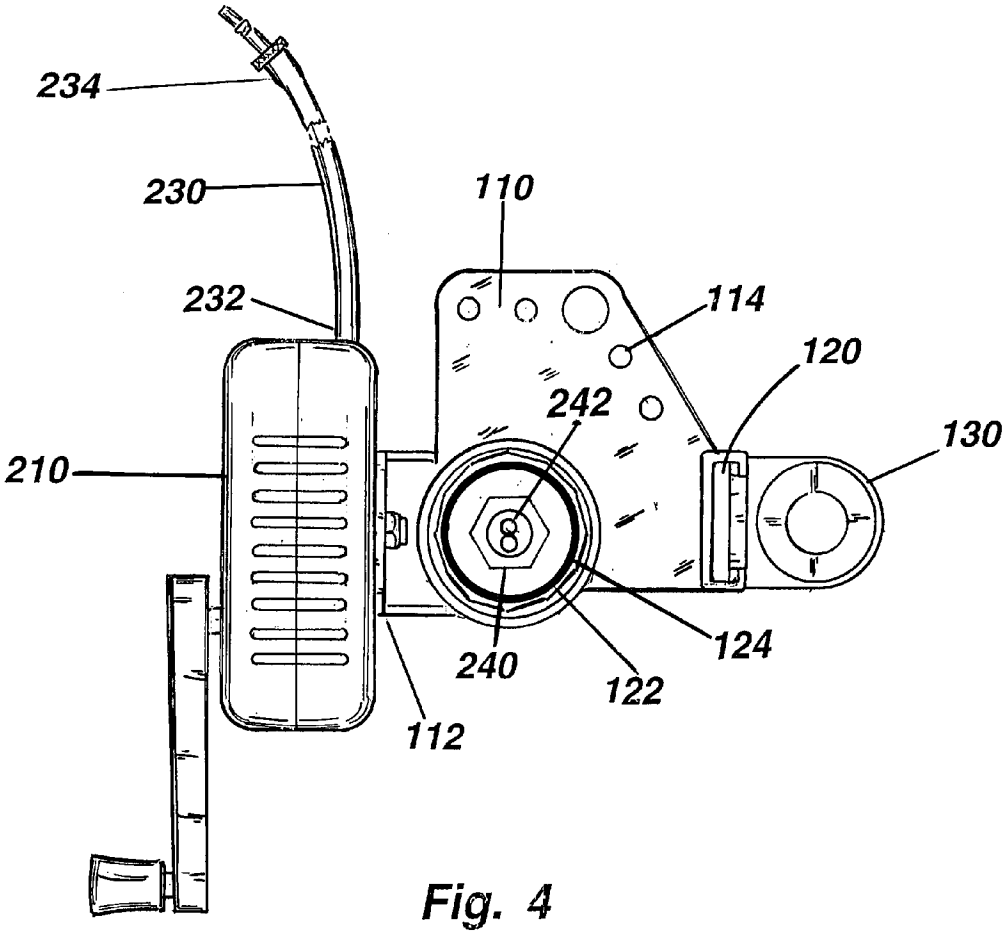
FIG. 4 depicts a bottom plan view of the first fuel assembly 100 of this invention.
Figure 5:
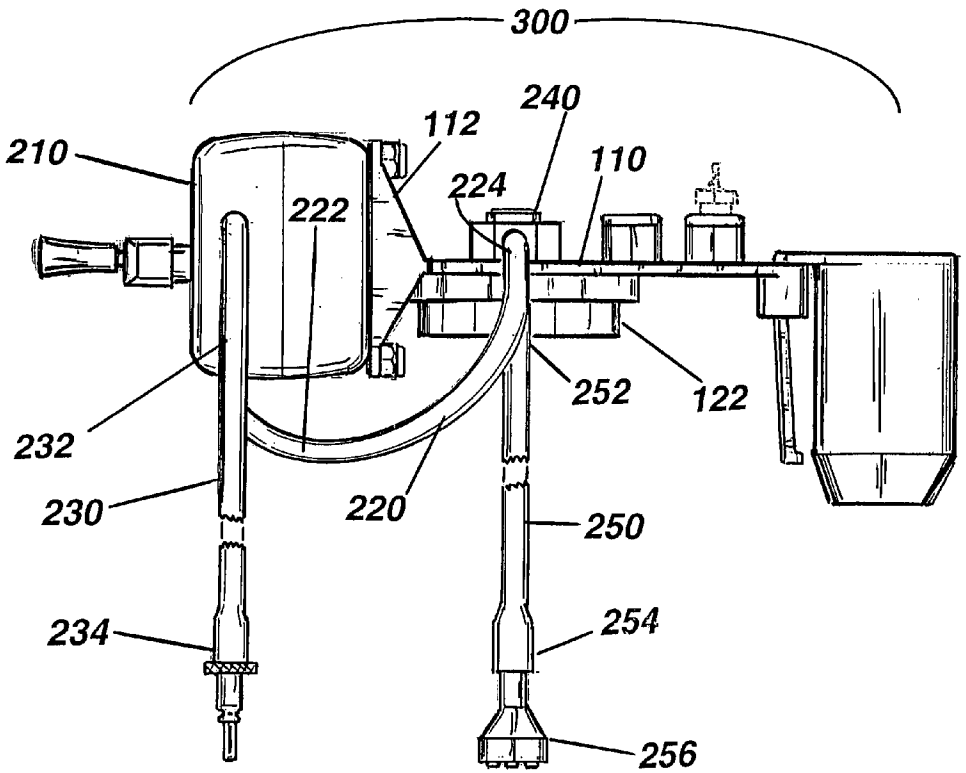
FIG. 5 depicts a side view of the first fuel assembly 100 of this invention.

Adding FIG. 3, FIG. 4 and FIG. 5, base 110 has threaded fitting 122 and o-ring 124 which allows base 110 to be secured to cylindrical fuel container 400 by screwing base 110 onto cylindrical fuel container 400 in place of the container's cap. With the combination of threaded fitting 122 and o-ring 124, base 110 provides a no-leak seal on cylindrical fuel container 400 and prevents any leakage or spillage of fuel. Base 110 also contains fuel pump bracket 112 which allows fuel pump 210 to be securely attached to base 110 as depicted in FIG. 2, FIG. 3, FIG. 4 and FIG. 5. Fuel pump 210 can be either manual with a fuel pump handle 260 or electric, and either single action (can pump fuel in one direction) or dual action (can pump fuel in both directions).

Fuel assembly 200 provides for the pumping of fuel. Fuel pump 210 attached to base 110 communicates with first filling end 222 of first filling hose 220 and with first draining end 232 of second draining hose 230. Second filling end 224, oppositely disposed from first filling end 222, of first filling hose 220 communicates with fitting 240. Fitting 240 contains a fitting aperture 242 which allows fluid to pass through the fitting 240 undisturbed. Fitting 240 also communicates with first suction end 252 of third suction hose 250. Ideally second suction end 254 of third suction hose 250 is immersed in fuel contained in fuel container 400. A combination of first filling hose 220 and third suction hose 250 in communication with fitting 240 provides a continuous open passage from fuel in cylindrical fuel container 400 to fuel pump 210.

Further, a combination of fuel pump 210, first filling hose 220, second draining hose 230, fitting 240 and third suction hose 250 allows fuel pump 210 to pump fuel 402 out of fuel container 400 and into another desired fuel container such as a fuel tank 104 in a radio-controlled miniature vehicle 105. This combination also allows for fuel 402 to be pumped out of a fuel tank 104 and back into the fuel container 400 or some other desired fuel container.

Although preferred, a fuel filter 256, which communicates with second end 254 of third hose 250 as depicted in FIG. 5, is not required. Also, fitting 240 preferably has fitting aperture 242, which allows the second draining end 234 of second draining hose 230 to be placed during transportation as depicted in FIG. 2, and to allow any remaining fuel in second hose 230 to drain back into fuel container 400.

Tool kit assembly 300 allows for secure holding and easy access to tools and spare parts. Located on base 110 are one to eight tool apertures 114, which are sized to accept various tools. Such tools include but are not limited to a plug wrench 140, an engine stopper 142 and a screw driver 144. Also located on base 110 are fittings 116, which allow a glow plug 148 to be securely attached to the base.

Located at the end of base 110 oppositely deposed from fuel pump bracket 112 is slot 120, which is shaped to receive glow plug igniter holder 130 and electric starter clip 136. Glow plug igniter 146 fits inside glow plug igniter holder 130 in order to facilitate its attachment to the tool kit assembly 300. Electric starter clip 136 is a U-shaped flexible strip attached to the side of electric vehicle starter 138 to facilitate its attachment to the tool kit assembly 300.

Figure 6:
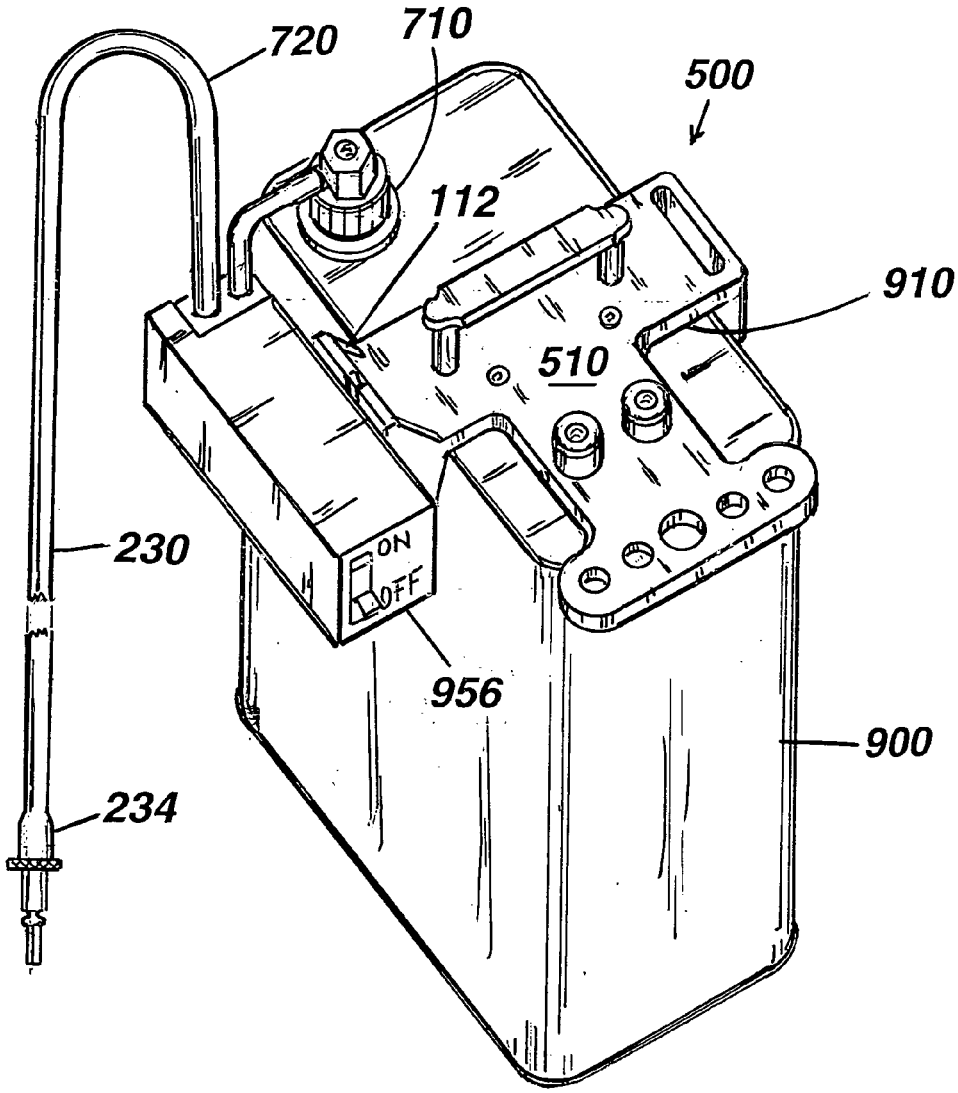
FIG. 6 depicts a perspective view of the second fuel assembly 500.
Figure 7:
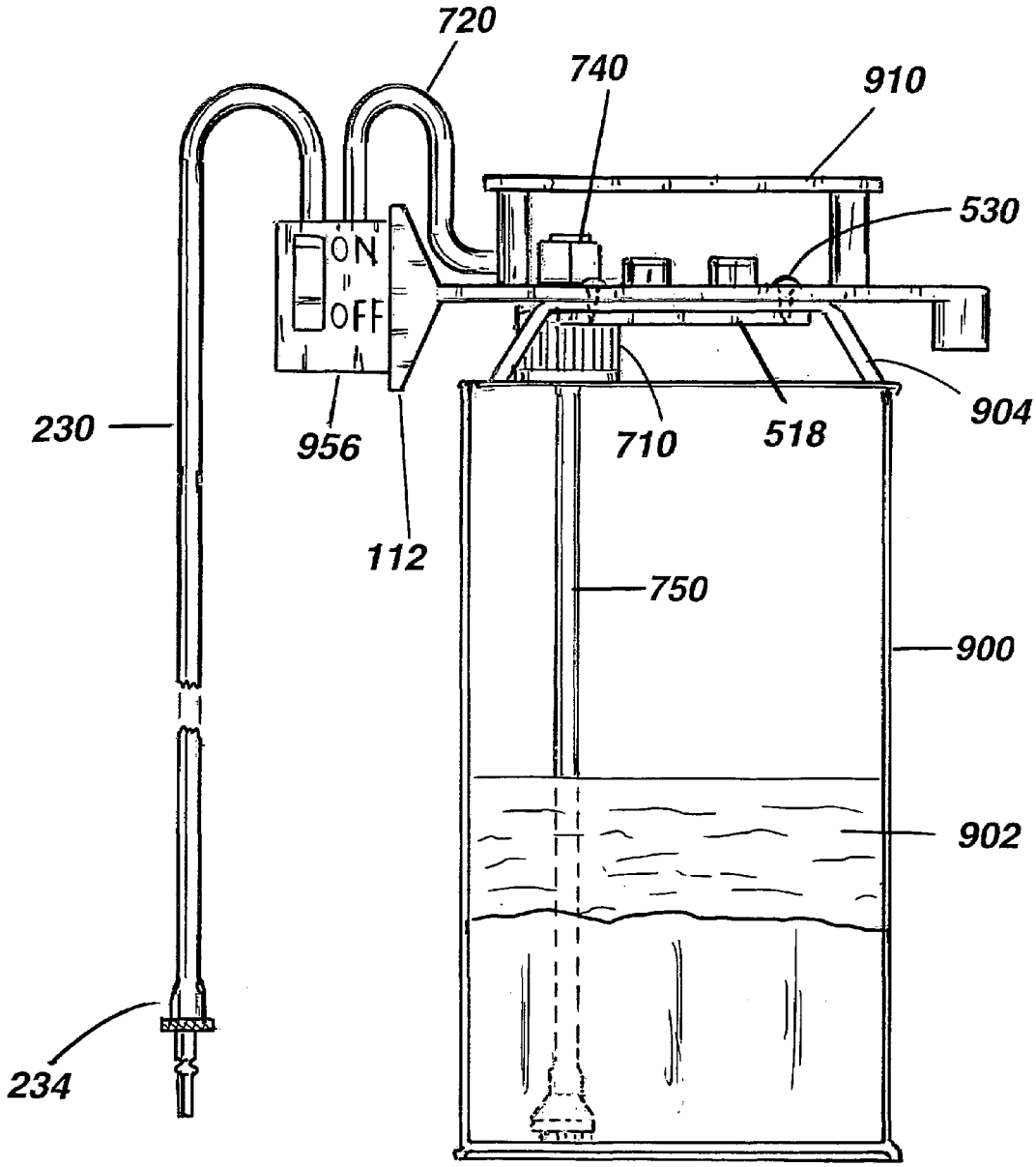
FIG. 7 depicts an end plan view of the second fuel assembly 500 based on FIG. 6.

A second embodiment of a portable fuel assembly 500 is depicted in FIG. 6 and FIG. 7. Such a fuel assembly 500 attaches to a handle 910 of a rectangular fuel container 900 rather than screwing onto the fuel container pouring spout, such as cylindrical fuel container 400, in the place of the cap. In this manner, a fuel assembly 500 can be attached to a fuel container 900, when attaching the fuel assembly by a threaded fitting is not desired.

The second fuel assembly 500, as depicted in FIG. 6 and FIG. 7, serves the same functions as the first fuel assembly 100 depicted in FIG. 1, FIG. 2, FIG. 3, FIG. 4 and FIG. 5. However, platform base 510 is attached to and above container handle 904 of the rectangular fuel container 900 with platform bracket 518 below handle 904. If desired, platform handle 910 may have therein finger slots 912 in order to assist the gripping of the container handle 904.

Platform base 510 and platform bracket 518 secure second fuel assembly 500 to rectangular fuel container 900 with screws 530. Also, a threaded cap 710 is provided with a cap fitting 740, which communicates with first block hose 720 and third block hose 750 to allow fuel pump 710 to pump fuel 902 out of rectangular fuel container 900 and into a desired container such as a fuel tank 104 radio-controlled miniature vehicle 105, as in FIG. 1.

Comparing FIG. 1 and FIG. 7, the main difference is seen in the type of container. Cylindrical fuel container 400 and rectangular fuel container 900 provide different structures for the mounting of a device thereon. Cylindrical fuel container 400 has a threaded cap 402, which is replaced with first pump assembly 100. Rectangular fuel container 900 includes a top handle 904 for mounting second fuel assembly 500 thereon.

Figure 8:
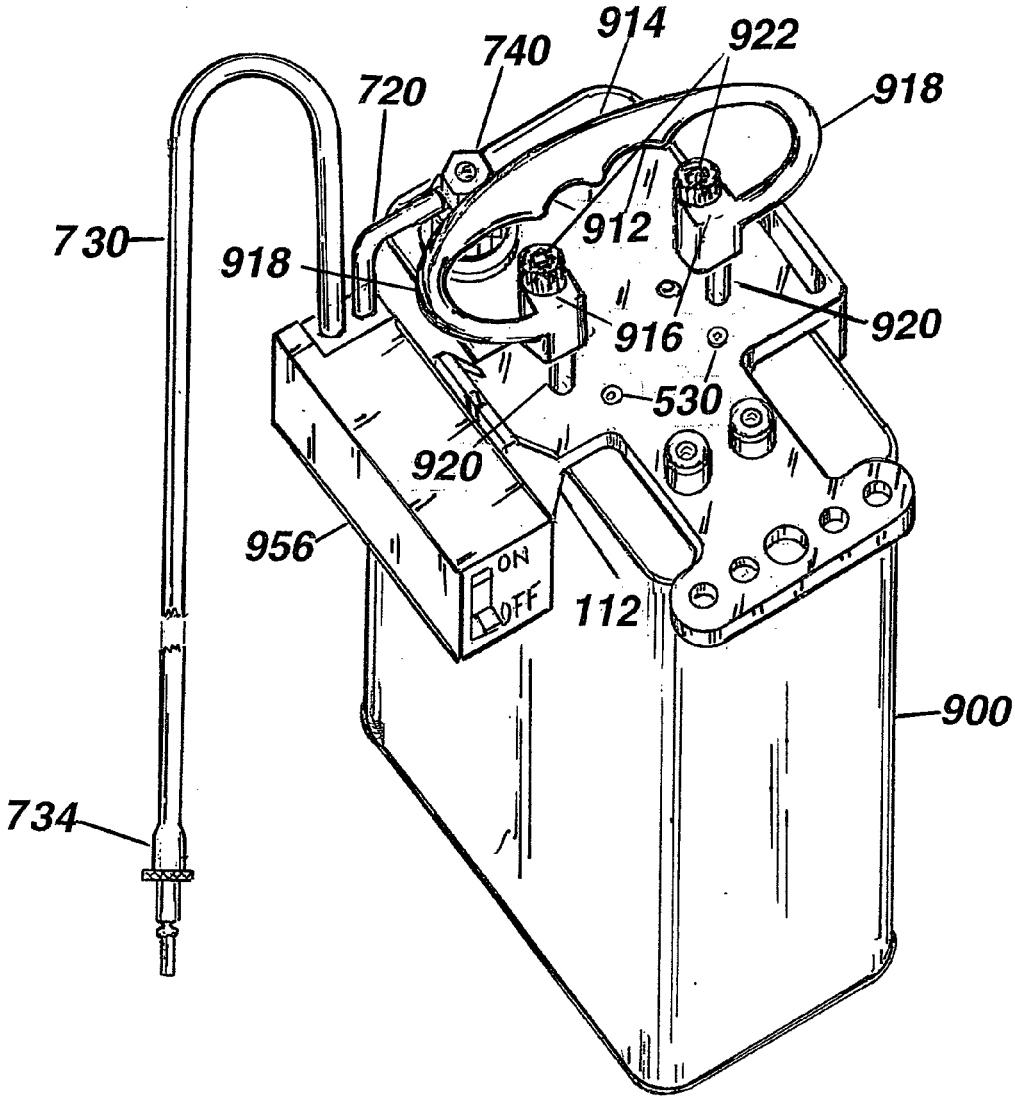
FIG. 8 depicts a perspective view of the second fuel assembly 500 with handle 910 modified.
Figure 9:
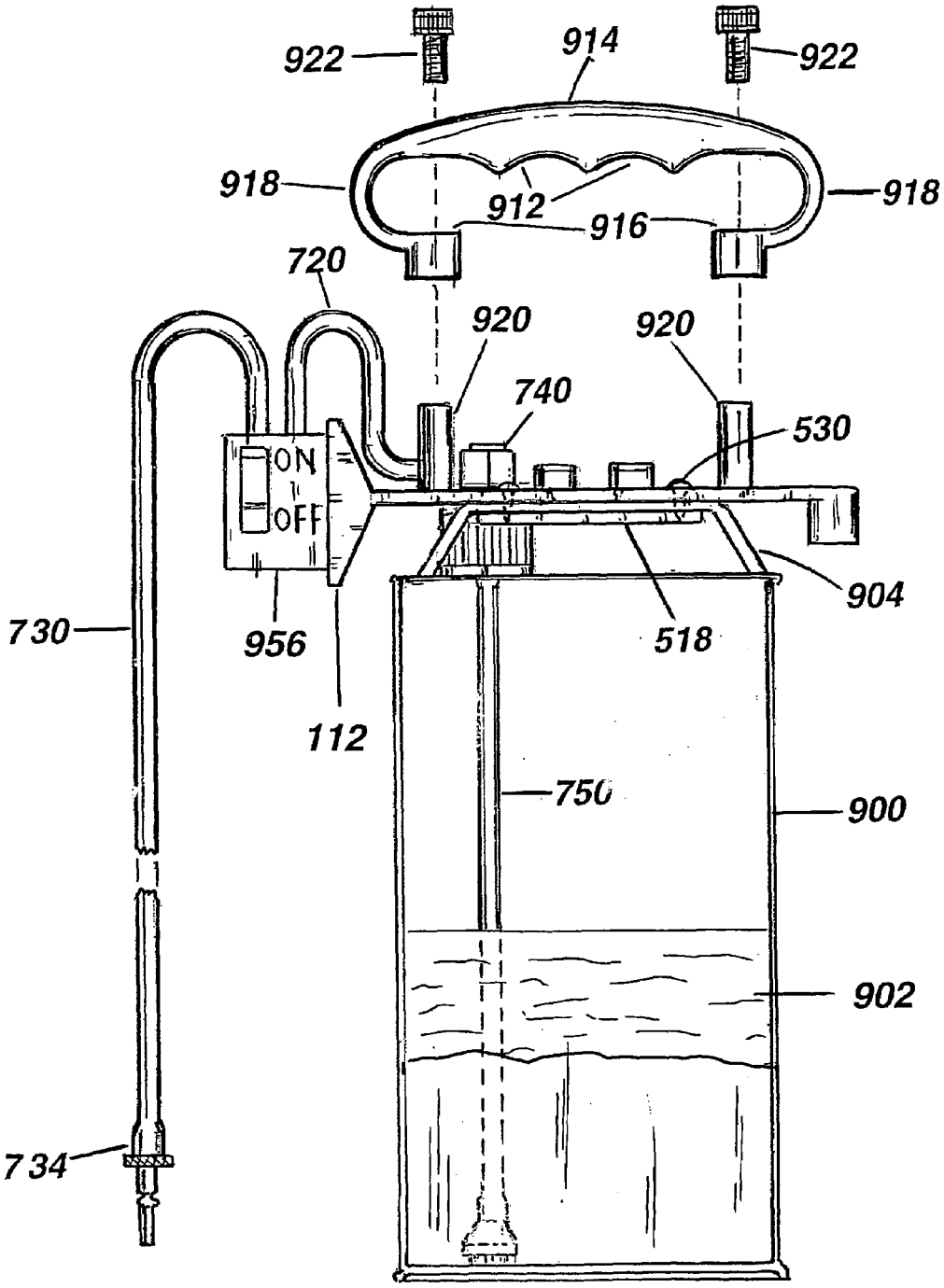
FIG. 9 depicts an end plan view of the second fuel assembly 500 based on FIG. 8.

FIG. 8 and FIG. 9 show the second fuel assembly 500 of FIG. 6 with handle 910 modified. More particularly, platform handle 910 has finger slots 912 therein. Finger slots 912 in gripping member 914 of platform handle 910 receive the fingers (not shown) of a person (not shown) in order to facilitate the carrying of second fuel assembly 500.

With end apertures 916 in arc ends 918 of gripping member 914, attachment to handle supports 920 of second fuel assembly 500 is accomplished with handle screws 922 in a standard fashion.

Figure 10:
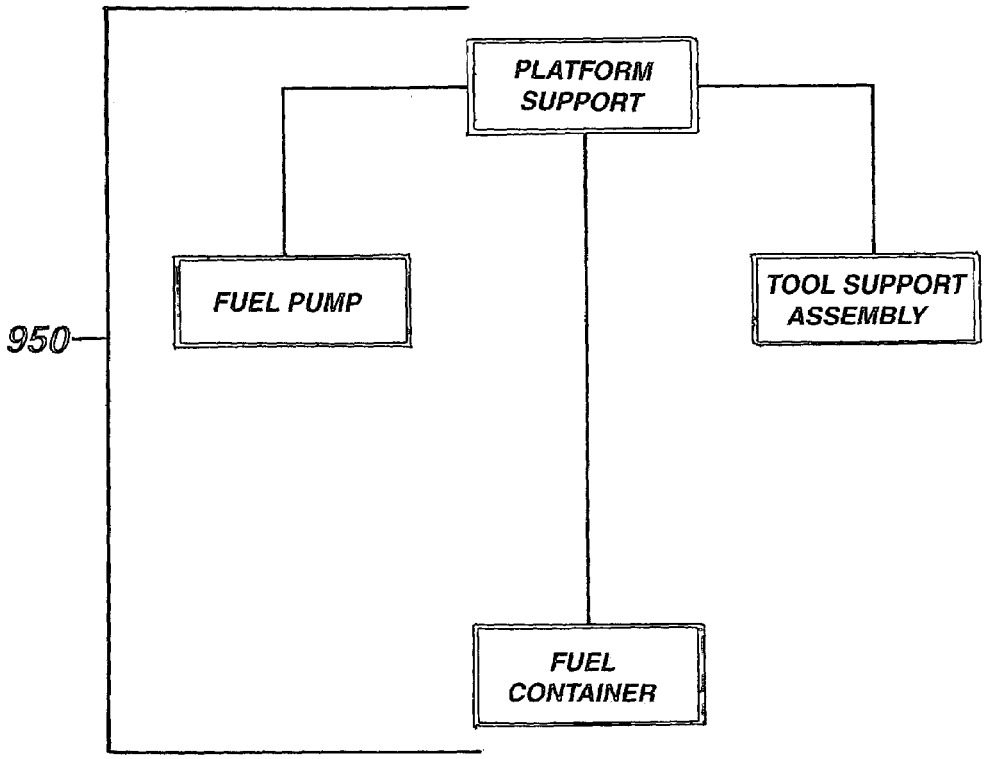
FIG. 10 depicts a block diagram showing the interrelation of platform support 952, fuel container 954, fuel pump 956 and tool support assembly 958.

FIG. 10 depicts a block diagram of a fuel clamp assembly 950 adaptable for attaching platform support 952 thereto. With platform support 952 secured to fuel supply 954 through fuel pump 956 and tool support assembly 958 container pump assembly to basic fuel supply 954.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A portable fuel assembly for a remote controlled vehicle comprising:

(a) the portable fuel assembly having a holder and a fuel container;

(b) the holder having a securing means in order to attach the holder to the fuel container in order to form the fuel assembly;

(c) a fuel pump being secured to the holder;

(d) the holder having at least one receiving means for receiving at least one member selected from the group consisting of at least one tool and at least one spare part;

(e) a hose assembly being adapted to releasably connect the fuel pump to a fuel source and a vehicle;

(f) the portable fuel assembly providing a convenient source for fuel for the remote controlled vehicle;

(g) the securing means securely attaching the holder to the fuel container in order to provide a secure foundation for the fuel pump and the receiving means;

(h) a communication means being adapted to connect the fuel pump to fuel in the fuel container and to the remote controlled vehicle;

(i) the communicating means having a fitting;

(j) the fitting having a first hose and a second hose;

(k) the first hose being adapted to connect to a source of fuel in the fuel container;

(l) the second hose being adapted to connect to the fuel pump or the remote control vehicle;

(m) the fitting having a fluid aperture;

(n) the fluid aperture being adapted to permit fuel to pass therethrough;

(o) the first hose and the second hose communicating with the fluid aperture;

(p) the second hose communicating with the fuel pump;

(q) a third hose communicating with the fuel pump at a first end with an oppositely disposed second end being adapted to communicate with the remote controlled vehicle; and (r) the securing means including a threaded fitting.

2. The portable fuel assembly of claim 1 further comprising:

(a) the securing means including a female threaded fitting;

(b) the fuel container including a male threaded fitting; and (c) the female threaded fitting receiving the male threaded fitting.

3. The portable fuel assembly of claim 2 further comprising:

(a) the fuel pump having a power source selected from the group consisting of a manual power source and an electric power source; and (b) the fuel pump having an action mechanism selected from the group consisting of a single action mechanism and a dual action mechanism.

4. The portable fuel assembly of claim 1 further comprising:

(a) the securing means including a platform base and a platform bracket;

(b) the platform base being attachable above a handle of the fuel container;

(c) the platform bracket being attachable below the handle of the fuel container;

(d) the platform base being attachable to the platform bracket; and (e) the platform base including the holder.

5. The portable fuel assembly of claim 4 further comprising:

(a) the securing means securely attaching the holder to the fuel container in order to provide a secure foundation for the fuel pump and the receiving means;

(b) a communication means being adapted to connect the fuel pump to fuel in the fuel container and to the remote controlled vehicle; and (c) the holder including a tool means for holding at least one tool thereon and a parts means for holding at least one spare part thereon.

6. The portable fuel assembly of claim 5 further comprising:

(a) the communicating means having a fitting;

(b) the fitting having a first hose and a second hose;

(c) the first hose being adapted to connect to a source of fuel in the fuel container; and (d) the second hose being adapted to connect to the fuel pump or the remote control vehicle.

7. The portable fuel assembly of claim 6 further comprising:

(a) the fitting having a fluid aperture;

(b) the fluid aperture being adapted to permit fuel to pass therethrough;

(c) the first hose and the second hose communicating with the fluid aperture;

(d) the second hose communicating with the fuel pump; and (e) a third hose communicating with the fuel pump at a first end with an oppositely disposed second end being adapted to communicate with the remote controlled vehicle.

8. The portable fuel assembly of claim 7 further comprising:

(a) the fuel pump having a power source selected from the group consisting of a manual power source and an electric power source; and (b) the fuel pump having an action mechanism selected from the group consisting of a single action mechanism and a dual action mechanism.

9. In a portable fuel assembly for a remote controlled vehicle having a fuel container with a generally rectangular shape and a container handle on a top portion thereof and a pumping assembly secured to the container handle of the fuel container, the improvement comprising:

(a) the pumping assembly including a holder;

(b) the holder having a securing means in order to attach the holder to the fuel container in order to form the fuel assembly;

(c) a fuel pump being secured to the holder;

(d) the holder having at least one receiving means for receiving at least one member selected from the group consisting of at least one tool and at least one spare part;

(e) a hose assembly being adapted to releasably connect the fuel pump to a fuel source and a vehicle;

(f) the portable fuel assembly providing a convenient source for fuel for the remote controlled vehicle (g) an assembly handle being secured to the holder;

(h) the securing means including a platform base and a platform bracket;

(i) the platform base being attachable above a handle of the fuel container;

(j) the platform bracket being attachable below the handle of the fuel container;

(k) the platform base being attachable to the platform bracket;

(l) the platform base including the holder; and (m) the assembly handle being secured to the platform base.

10. The portable fuel assembly of claim 9 further comprising:

(a) the securing means securely attaching the holder to the fuel container in order to provide a secure foundation for the fuel pump and the receiving means;

(b) a communication means being adapted to connect the fuel pump to fuel in the fuel container and to the remote controlled vehicle; and (c) the holder including a tool means for holding at least one tool thereon and a parts means for holding at least one spare part thereon.

11. The portable fuel assembly of claim 10 further comprising:

(a) the communicating means having a fitting;

(b) the fitting having a first hose and a second hose;

(c) the first hose being adapted to connect to a source of fuel in the fuel container; and (d) the second hose being adapted to connect to the fuel pump or the remote control vehicle.

12. The portable fuel assembly of claim 11 further comprising:

(a) the fitting having a fluid aperture;

(b) the fluid aperture being adapted to permit fuel to pass therethrough;

(c) the first hose and the second hose communicating with the fluid aperture;

(d) the second hose communicating with the fuel pump; and (e) a third hose communicating with the fuel pump at a first end with an oppositely disposed second end being adapted to communicate with the remote controlled vehicle.

13. The portable fuel assembly of claim 12 further comprising:

(a) the fuel pump having a power source selected from the group consisting of a manual power source and an electric power source;

(b) the fuel pump having an action mechanism selected from the group consisting of a single action mechanism and a dual action mechanism; and (c) the assembly handle having finger slots in order to assist the gripping of the assembly handle.

14. In a portable fuel assembly for a remote controlled vehicle having a fuel container with a generally cylindrical shape and a male threaded opening on a top portion thereof and a pumping assembly secured to the fuel container, the improvement comprising:

(a) the holder having a securing means in order to attach the holder to the fuel container in order to form the fuel assembly;

(b) a fuel pump being secured to the holder;

(c) the holder having at least one receiving means for receiving at least one member selected from the group consisting of at least one tool and at least one spare part;

(d) a hose assembly being adapted to releasably connect the fuel pump to a fuel source and a vehicle (e) the portable fuel assembly providing a convenient source for fuel for the remote controlled vehicle;

(f) the securing means securely attaching the holder to the fuel container in order to provide a secure foundation for the fuel pump and the receiving means;

(g) a communication means being adapted to connect the fuel pump to fuel in the fuel container and to the remote controlled vehicle;

(h) the holder including a tool means for holding at least one tool thereon and a parts means for holding at least one spare part thereon;

(i) the communicating means having a fitting;

(j) the fitting having a first hose and a second hose;

(k) the first hose being adapted to connect to a source of fuel in the fuel container;

(l) the second hose being adapted to connect to the fuel pump or the remote control vehicle;

(m) the fitting having a fluid aperture;

(n) the fluid aperture being adapted to permit fuel to pass therethrough;

(o) the first hose and the second hose communicating with the fluid aperture; and (p) the second hose communicating with the fuel pump.

15. The portable fuel assembly of claim 14 further comprising:

(a) the securing means including a female threaded fitting;

(b) the fuel container including a male threaded fitting;

(c) the female threaded fitting receiving the male threaded fitting;

(d) a third hose communicating with the fuel pump at a first end with an oppositely disposed second end being adapted to communicate with the remote controlled vehicle;

(e) the fuel pump having a power source selected from the group consisting of a manual power source and an electric power source; and (f) the fuel pump having an action mechanism selected from the group consisting of a single action mechanism and a dual action mechanism.

* * * * *